US011505885B2

(12) United States Patent
Demange et al.

(10) Patent No.: US 11,505,885 B2
(45) Date of Patent: Nov. 22, 2022

(54) ELLIPTICAL NEEDLELOOM HAVING A SEALED CASING AND A GUIDING THROUGH TILTING POT

(71) Applicant: ANDRITZ ASSELIN-THIBEAU, Elbeuf (FR)

(72) Inventors: Frédéric Demange, Montville (FR); Eric Potdevin, Barneville-sur-Seine (FR)

(73) Assignee: ANDRITZ ASSELIN-THIBEAU, Elbeuf (FR)

( * ) Notice: Subject to any disclaimer, the term of this patent is extended or adjusted under 35 U.S.C. 154(b) by 0 days.

(21) Appl. No.: 17/237,485

(22) Filed: Apr. 22, 2021

(65) Prior Publication Data

US 2021/0332514 A1 Oct. 28, 2021

(30) Foreign Application Priority Data

Apr. 23, 2020 (FR) ..... 20 04057

(51) Int. Cl.
*D04H 18/02* (2012.01)

(52) U.S. Cl.
CPC ..... *D04H 18/02* (2013.01)

(58) Field of Classification Search
CPC ..... D04H 18/02; D04H 18/00; D04H 1/46; D04H 3/102; D04H 3/105; D04H 5/02
USPC ..... 28/114, 107, 115
See application file for complete search history.

(56) References Cited

U.S. PATENT DOCUMENTS 3,849,845 A * 11/1974 Obenaus ..... D04H 18/02 28/107
5,822,834 A * 10/1998 Jourde ..... D04H 18/02 28/107
5,873,152 A * 2/1999 Jourde ..... D04H 18/02 74/44
6,000,112 A * 12/1999 Ollinger ..... D04H 18/02 28/107

(Continued)

FOREIGN PATENT DOCUMENTS

EP 1736587 A1 12/2006
FR 2800396 A1 5/2001

(Continued)

OTHER PUBLICATIONS

INPI Search Report dated Jan. 13, 2021 in related application No. FR 2004057.

*Primary Examiner* — Amy Vanatta
(74) *Attorney, Agent, or Firm* — Renner, Kenner, Greive, Bobak, Taylor & Weber

(57) ABSTRACT

A needling device to consolidate a fleece. The device including at least one needle plate with an array of needles; at least one column with its longitudinal axis rigidly connected to the at least one needle plate; drive systems; a sealed housing; and at least one guide pot. The drive systems are configured to impart to the at least one column a to and fro motion so that the needles follow an elliptical path to pass through, in one direction then the other, the fleece that passes in front of it in the machine drive direction to consolidate it. The sealed housing containing part of the column and drive systems and wherein the at least one guide pot is fitted in an opening in the sealed housing and oscillates in relation to an axis of oscillation perpendicular to the longitudinal axis and the machine drive direction.

18 Claims, 10 Drawing Sheets

(56) References Cited

U.S. PATENT DOCUMENTS

| | | | | |
|---|---|---|---|---|
| 6,161,269 | A * | 12/2000 | Dilo | D04H 18/02 28/107 |
| 6,266,856 | B1 * | 7/2001 | Fehrer | D04H 18/02 28/107 |
| 6,305,058 | B1 * | 10/2001 | Fehrer | D04H 18/02 28/107 |
| 6,389,665 | B1 * | 5/2002 | Fuchs | D04H 18/02 28/107 |
| 6,785,940 | B1 * | 9/2004 | Muller | D04H 18/00 28/107 |
| 7,107,658 | B2 * | 9/2006 | Muller | D04H 18/00 28/114 |
| 2003/0056347 | A1 * | 3/2003 | Pum | D04H 18/02 28/107 |
| 2006/0288549 | A1 * | 12/2006 | Jean | D04H 18/02 28/107 |
| 2007/0006432 | A1 * | 1/2007 | Noel | D04H 18/02 28/107 |
| 2012/0167361 | A1 * | 7/2012 | Reutter | D04H 18/02 28/107 |

FOREIGN PATENT DOCUMENTS

| | | | |
|---|---|---|---|
| FR | 2862988 | A1 | 6/2005 |
| WO | 9621764 | A1 | 7/1996 |

* cited by examiner

[Fig. 1]
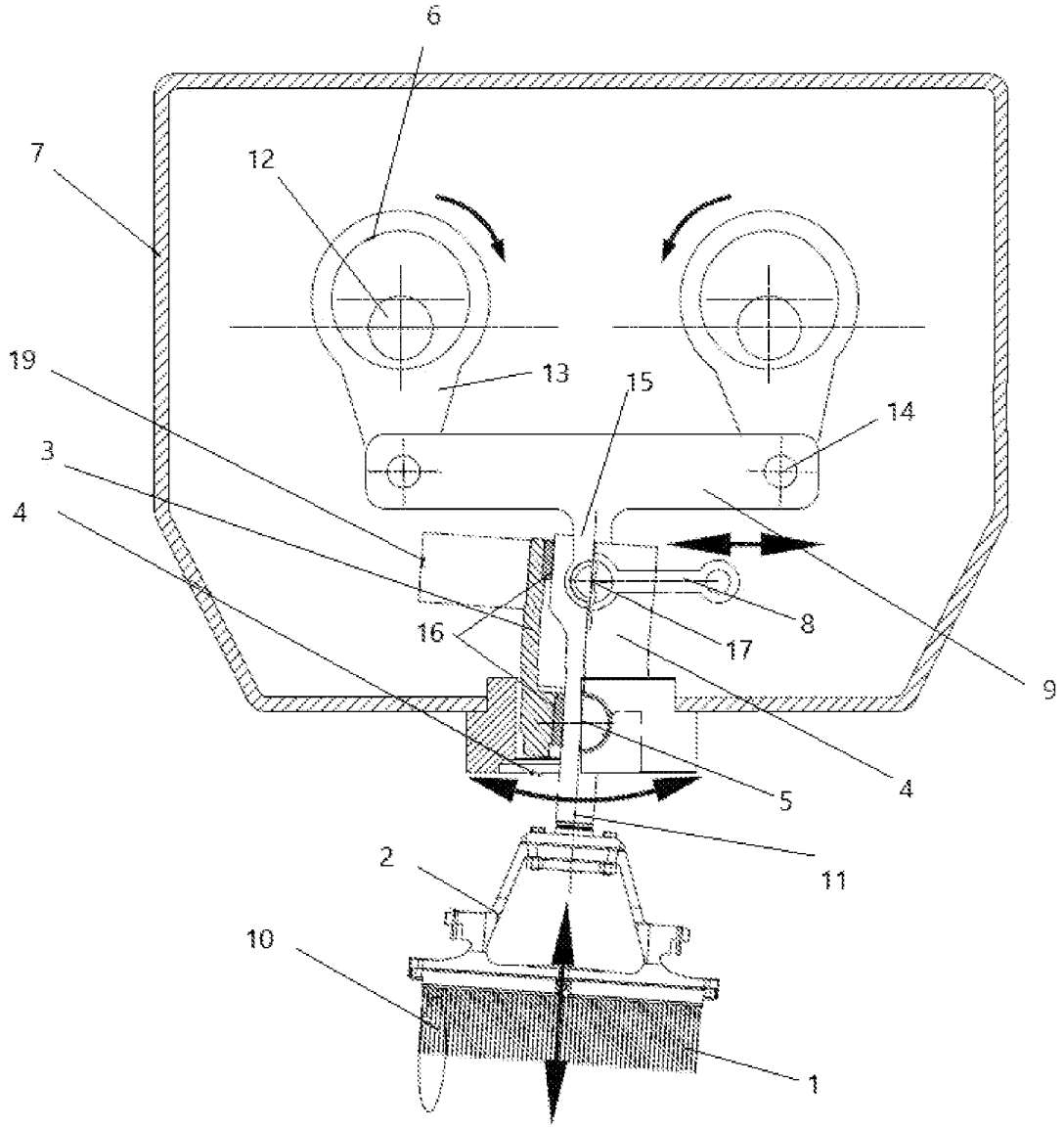

[Fig. 1A]
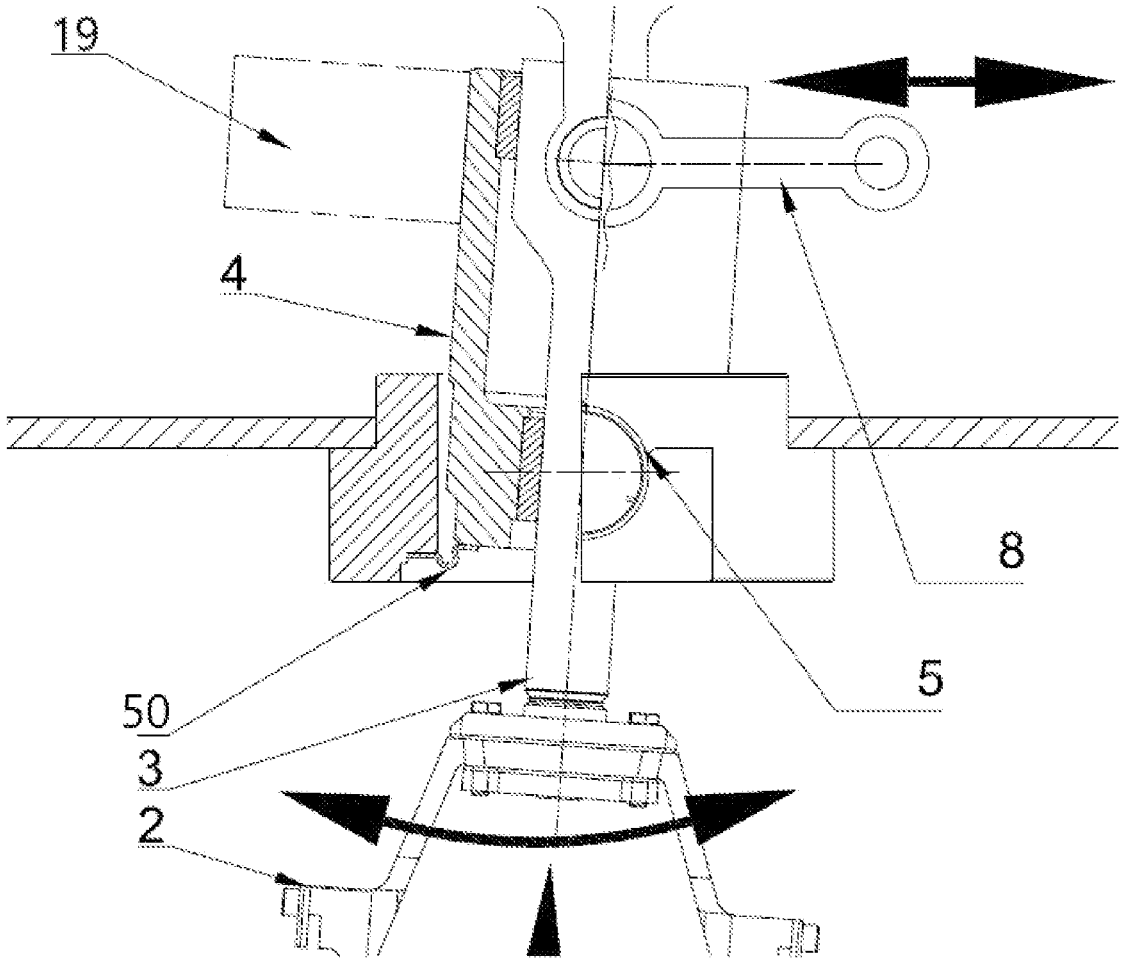

[Fig. 2]
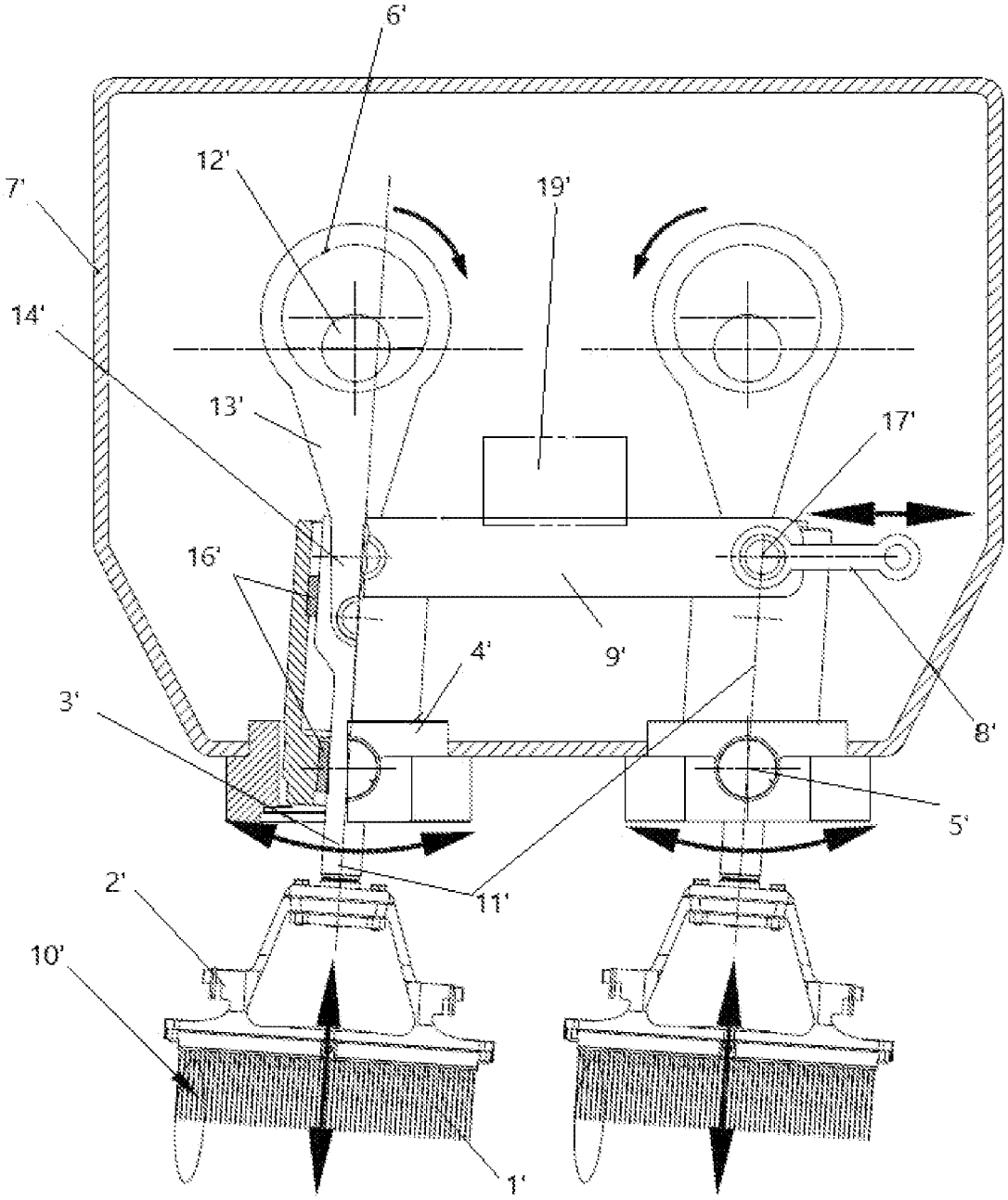

[Fig. 2A]
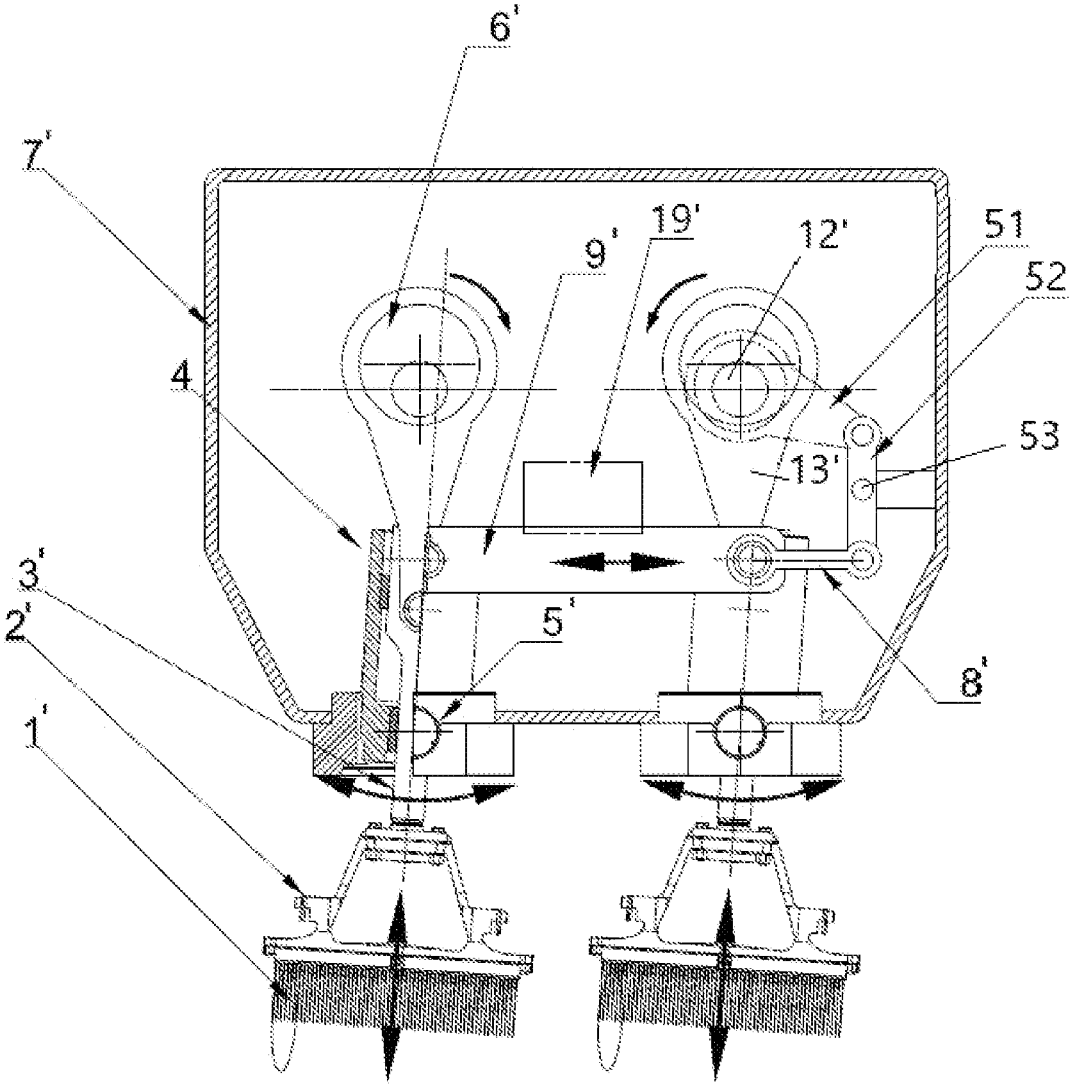

[Fig. 3]
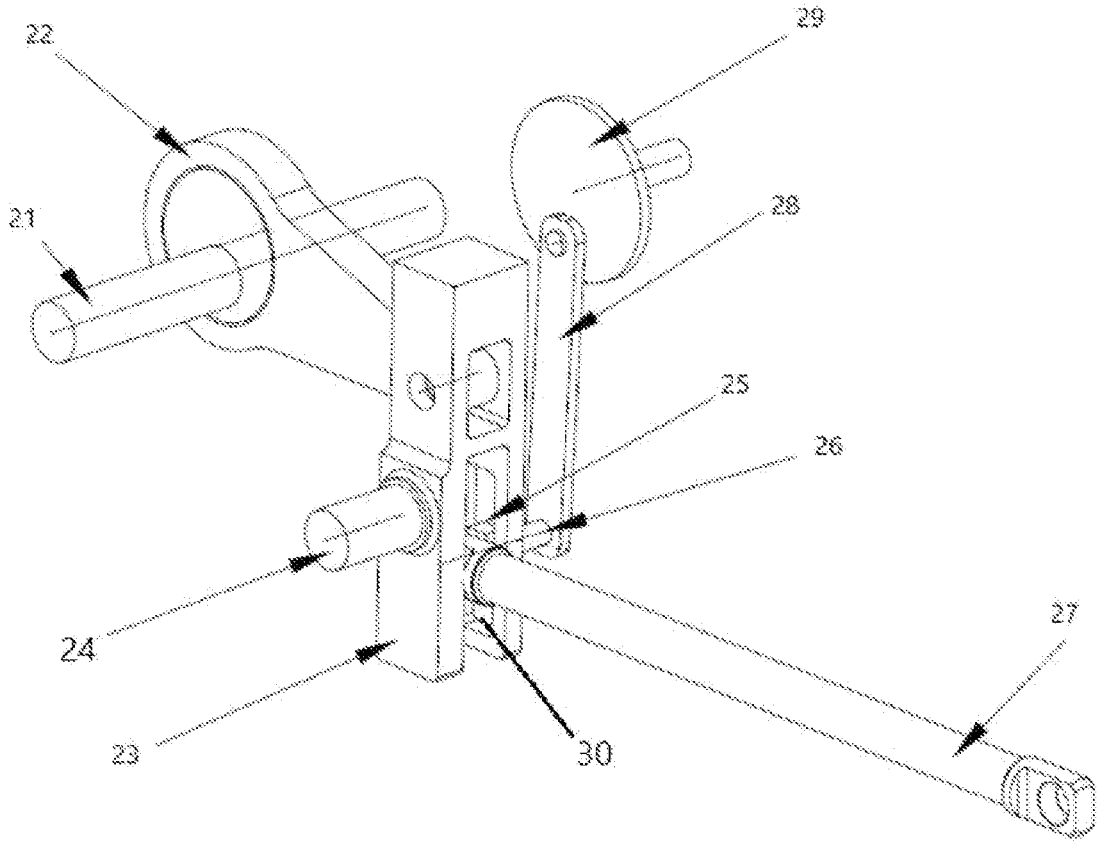

[Fig. 3A]
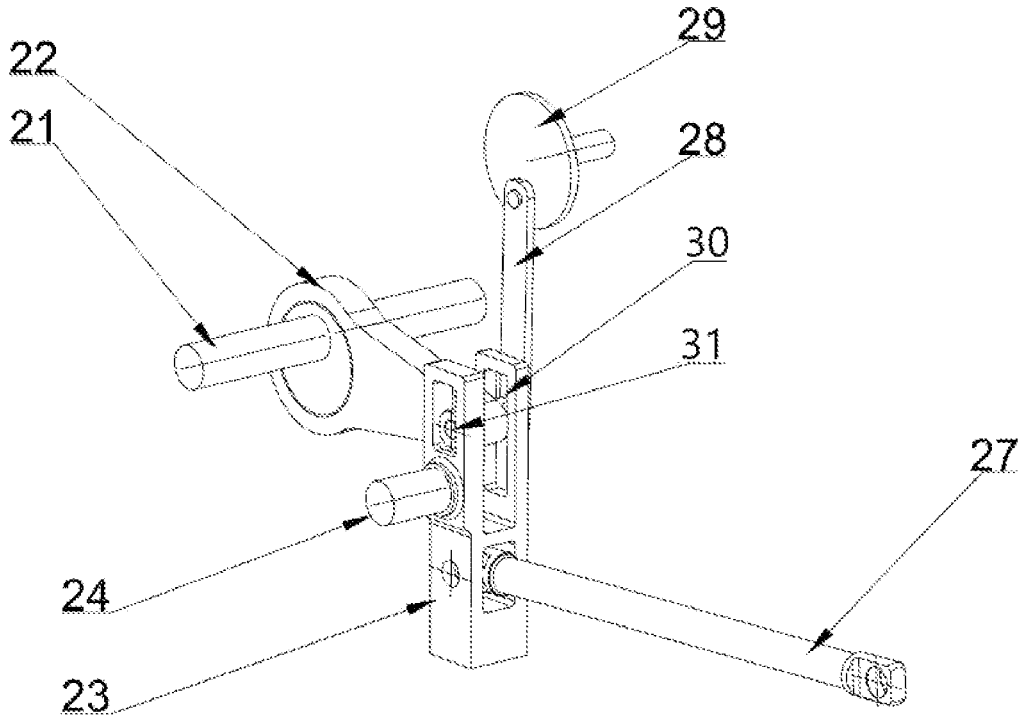

[Fig. 3B]
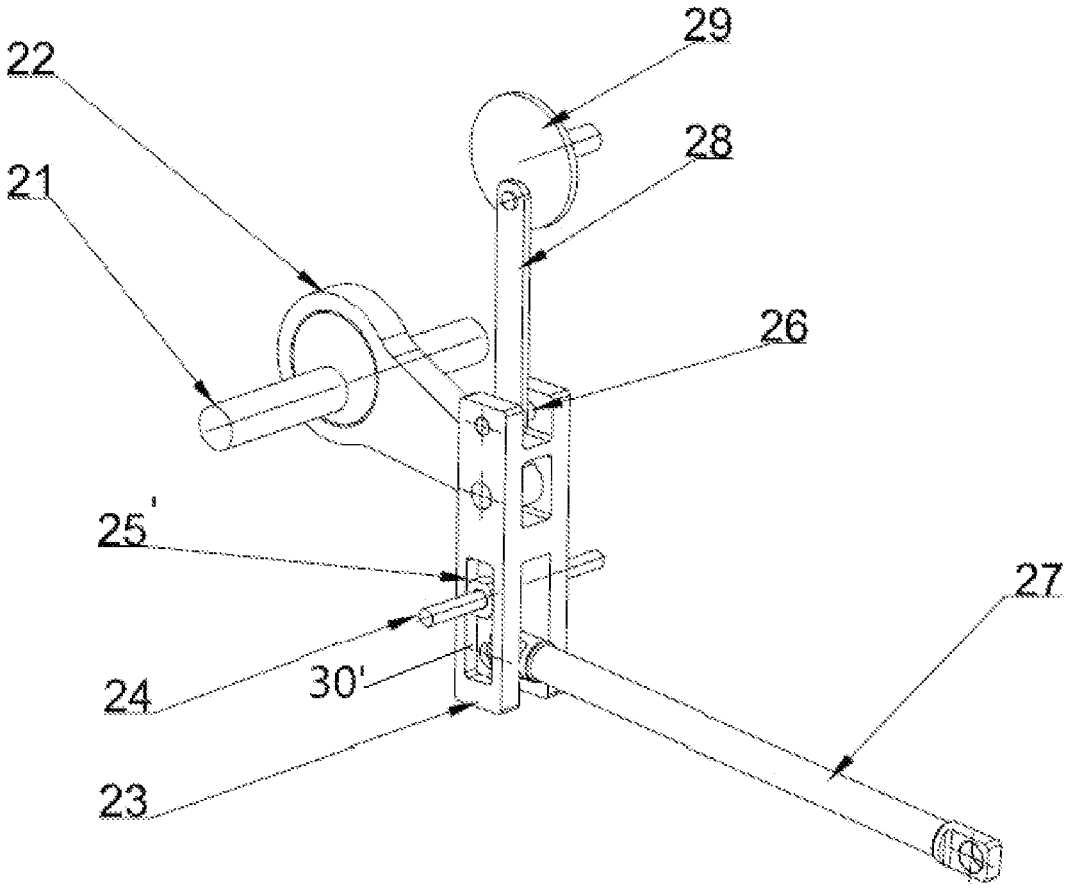

[Fig. 4A]
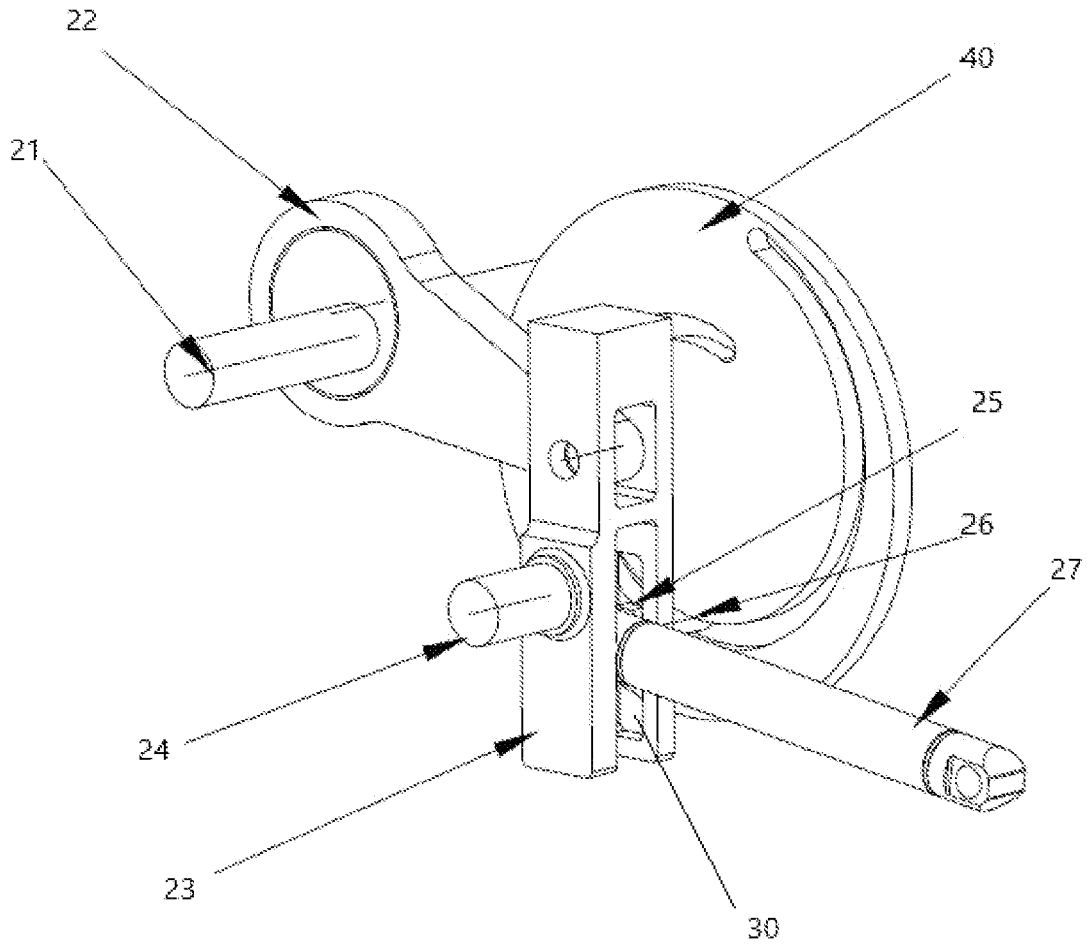

[Fig. 4B]
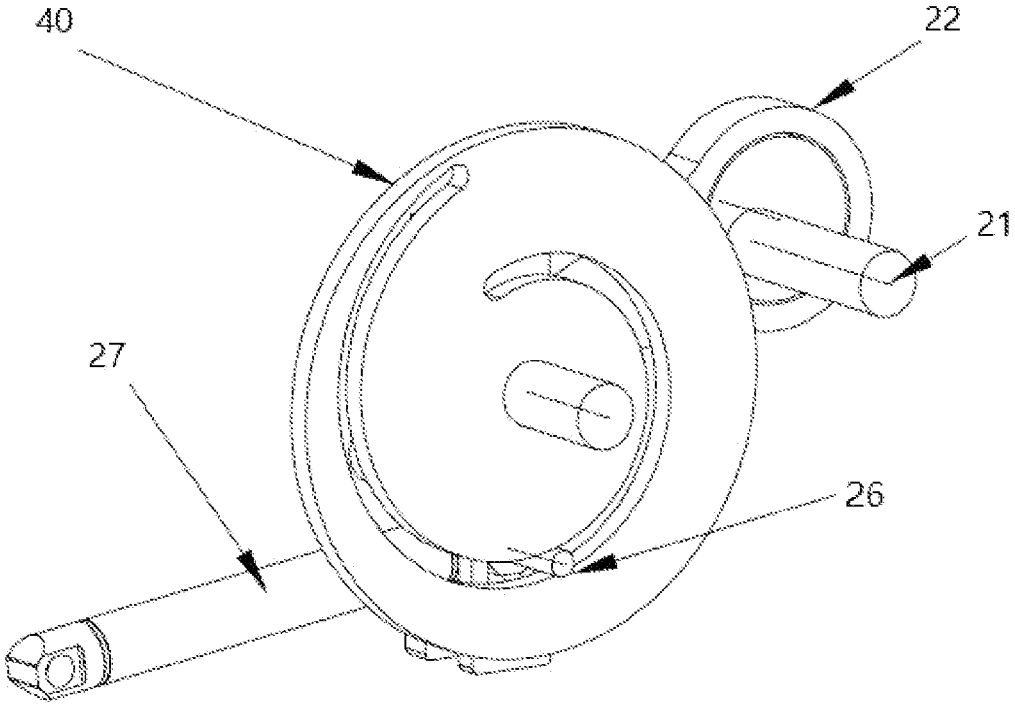

[Fig. 5]
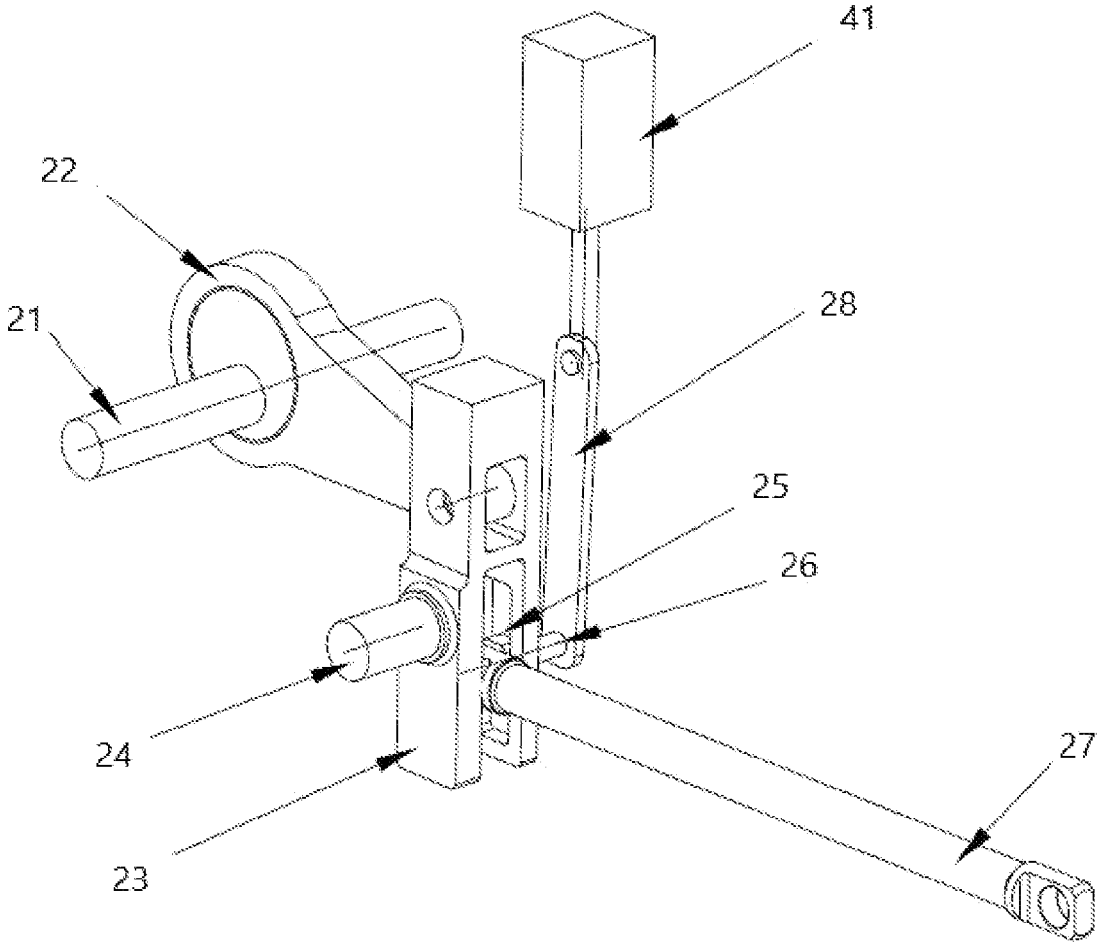

ELLIPTICAL NEEDLELOOM HAVING A SEALED CASING AND A GUIDING THROUGH TILTING POT

TECHNICAL FIELD

The present invention refers to a needle plate machine to consolidate by needling a fleece or web of fibres, in particular non-woven, comprising at least one needle plate, in front of which the fleece or web of fibres passes while moving forwards in the machine or MD direction, and a drive system configured to impart to at least one column integrated with the at least one needle plate and/or needles a to and fro motion in a direction perpendicular or essentially perpendicular to the plane of the mat or fabric so that the needles traverse the sheet or layer of fibres in an elliptical path first in one direction and then the other.

BACKGROUND

A needle plate machine of this type is known, for example from EP-A1-1736586 in the name of the applicant. The needle plate is connected to a rod or column that extends along a longitudinal axis and passes through the wall of an intermediate housing sliding through a guide pot with a motion both vertical and in the direction MD thereby giving the needles an elliptical motion, the pot being arranged so that it can pivot with respect to an axis extending in the direction CD (that is to say perpendicular to both the vertical direction and the direction MD).

This needling device of the prior art has the advantage of being able to be contained for the most part, namely the greater part of the column and the system for driving the column, in a sealed housing providing lubrication for the various parts and mechanical linkages to ensure increased life and reliability of the installation.

This needling device however has the problem of being a complex structure, requiring, in particular, means for providing a phase shift between the two cam shafts that drive the column to give it an elliptical motion.

A needling device with the same advantage of being able to be contained in a sealed housing providing good lubrication of the various drive components of the column, but while having a more compact, less complex structure is desirable.

A needling device is also known from FR-A1-2800396 comprising a needle plate, a column connected to the needle plate, a driving system configured to impart an elliptical to and fro motion to the column, a housing that contains a part of the column, a part of the drive system and a sleeve arranged in an opening in the housing, the column passing through the housing through the sleeve. In this complex device, the housing is not sealed and parts of the drive system, namely those designed to impart a transverse motion in the direction MD are outside the housing.

SUMMARY OF THE INVENTION

According to the invention, a device to consolidate a fleece or web of fibres, in particular non-woven, by needling is as defined in claim 1.

According to the invention, a less complex system than that of the prior art is thereby obtained, in particular from a mechanical point of view, which is also more compact. In particular, it is no longer necessary to provide phase shift between two cam shafts. At the same time, the possibility of integrating the whole drive system in a sealed housing is retained and even enhanced, providing lubrication of the various mechanical components thereby ensuring long life and reliability of the installation.

Improvements and beneficial methods of implementation are defined in the claims below.

According to one beneficial method of implementation, the transverse drive system comprises a control device which in itself is an invention independent of the invention described above, but which can be combined with it, which includes: a drive rod coupled to the needles and/or the needle plate and/or to a component connected to the needle plate and/or to an oscillating pot to give them a to and fro motion in a direction essentially parallel to the direction MD or parallel to the direction MD, a cam shaft and a rod, the cam shaft driving the rod round in one axis of rotation, in particular in the direction CD perpendicular to the direction MD and to the vertical direction, and a rod connected to the tie-rod by means of a part forming an intermediate lever, comprising a single part or several parts not hinged together, pivoting with respect to a pivot pin, in particular parallel to the rotation pin of the cam shaft, the lever being hinged firstly directly to the rod, in particular in a direction parallel to the pivot pin and spaced apart from it, and secondly directly to the drive rod, in particular at a point spaced apart from the pivot pin to impart to the latter the to and fro motion in the direction MD.

Preferably, the control device includes means for adjusting the stroke of the to and fro motion of the drive rod.

In particular, the adjustment system adjusts the distance between the pivoting axis of the lever and the drive rod and/or the distance between the pivot pin of the lever and the rod.

According to a preferred method of implementation, the adjustment system comprises a slider connected to the drive rod or the pivot pin of the lever or of the hinge pin of the rod to the lever, the slider and the lever being arranged to enable the slider to slide in relation to the lever between several positions, and means for locking the slider to the lever in each of the said several positions.

According to a highly favourable method of implementation, the adjustment system comprises a guide slot in which the slider can slide between two extreme positions, in particular a high position in which the drive rod is located level with the pivot pin and a low position in which the drive rod is at its maximum distance from the pivot pin which the slider is connected to the lever, thereby enabling adjustment of the amplitude of the to and fro motion of the rod, in particular between zero amplitude (rod stationary) and maximum amplitude.

According to a preferred method of implementation, the means for fixing the position of the slider in the slot comprises an adjusting rod connected to an adjusting tie-rod, the adjusting tie-rod being hinged to an auxiliary adjustment cam shaft, rotating the auxiliary adjustment shaft enabling the position of the slider in the slot to be adjusted and locked.

According to another favourable method of implementation, the means for fixing the position of the slider in the slot comprise an adjusting rod connected to a spiral cam comprising a disk driven round by an auxiliary adjustment shaft with a spiral slot along which the adjustment rod can move.

According to yet another favourable variant, the system for fixing the position of the slider in the slot comprises an adjusting rod connected to an adjusting tie-rod driven by an actuator, permitting linear motion of the adjusting tie-rod, the adjusting tie-rod pivoting with respect to the axis of the adjusting rod.

BRIEF DESCRIPTION OF THE DRAWINGS

As an example, preferred methods of implementation of the invention will now be described with reference to the drawings in which:

FIG. 1 is a front view of the assembly, partly in cross section and cut away, of a needling device according to a first method of implementation of the invention;

FIG. 1A is a larger scale view of part of FIG. 1;

FIG. 2 is a front view of the assembly, partly in cross section and cut away, of a needling device according to another method of implementation according to the invention;

FIG. 2A is a front view of the assembly, partly in cross section and cut away, of a needling device according to yet another method of implementation according to the invention;

FIG. 3 is a perspective view of the control system of the principal rod forming the transverse drive system;

FIG. 3A is a perspective view of another method of implementation of a control system according to the invention;

FIG. 3B is a perspective assembly view of a method of implementation of a control system according to the invention;

FIG. 4A is an assembly view of a variant of the system in FIG. 3;

FIG. 4B is a rear view of the variant in FIG. 4A; and

FIG. 5 is an assembly view of yet another variant of the system in FIGS. 3, 4A and 4B.

DETAILED DESCRIPTION OF THE INVENTION

FIG. 1 shows a first method of implementation of a needle plate machine according to the invention. The housing is shown in cross section and the rest of the needle plate machine in front view with part of the guide pot cut away.

This needle plate machine comprises a needle plate 10 consisting of needles 1 projecting from the lower face of the plate and arranged either in rows and columns, or randomly, or pseudo-randomly, as is well known in the field. The needle plate 10 is carried by a beam 2, called the moving beam. The beam 2 and plate 10 are connected together but separable, so that broken or worn needles can easily be replaced with a new plate. The needles are designed to have an elliptical motion perpendicular, or essentially perpendicular, to the plane of the fleece or web, in particular alternately up and down to pass through in one direction, then the other, a fleece or web of fibres passing in front of them in the driven or MD direction, that is from left to right horizontally in the diagram.

A longitudinal column 3 extending along a longitudinal axis 11 perpendicular to the plane of the plate is connected to the moving beam 2 so that movements of the column 3, the moving beam 2, the needle plate 10 and the needles are identical, that is with the same elliptical motion.

A drive system is provided to impart to the column 3 (and therefore also to the needle plate 10, the moving beam 2 and the needles 1) a motion having a component in a direction parallel to the longitudinal axis 11 and a component in the direction MD, so as to have an elliptical path as shown in FIG. 1 by an ellipse for the needles.

A sealed housing 7 encloses the drive system and part of the column 3, the latter passing through the wall of the housing 7 through a guide pot 4, whose interface with the housing 7 is made oil-tight by means of a seal, that according to a possible method of implementation may take the form of a bellows joint 50. The guide pot 4 can oscillate with respect to an axis 5 fixed in respect of the housing 7, parallel to the direction CD (perpendicular to direction MD and the longitudinal axis 11). The column 3 can slide inside the guide pot 4. Guide bushes 16 are fitted to the internal wall of the guide pot 4 to ensure sliding and lubrication between the column 3 and the guide pot 4. Oil-tightness between the column 3 and the pot guide 4 is ensured by a seal (not shown) fixed to the base of the guide pot.

Highly beneficially, in particular in terms of the life and oil-tightness of the housing, the shaft 5 is located essentially at the level of the housing traversed by the guide pot 4, in particular in the opening.

The drive system comprises the first longitudinal drive system configured to impart a to and fro motion to the column in a direction parallel to the longitudinal axis. The first drive systems consist of systems 6 with cam shafts 12 and rods 13 and an intermediate tie-rod 9.

The shafts 12 drive the heads of the two rods 13 in opposite directions (as shown by the two arrows at the top in FIG. 1). The feet 14 of the two rods 13 are each hinged to one end of the intermediate tie-rod 9 which extends in the direction MD. The intermediate tie-rod 9 also comprises a stem 15 extending centrally downwards. The end of the stem 15 is hinged to the upper end of the column 3.

These first longitudinal drive systems impart to the column 3 *a* solely to and fro motion in relation to the longitudinal axis.

Second transverse drive systems are also fitted in the form of a main tie-rod 8 in the direction MD. One end of the tie-rod 8 is hinged to the guide pot 4, the interior of the housing 7, at a point 17 away from the axis of rotation 5 of the pot, in particular essentially to the upper end of the pot 4. An oscillating to and fro motion is thus imparted to the guide pot 4 that is repeated by the column 3 which crosses it with a to and fro motion in the direction MD, or essentially in the direction MD (as shown by the double arrow above the tie-rod 8 in FIG. 1). The other end of the tie-rod 8 is coupled to a control system, called the advance system, which in particular can be like that shown below in FIGS. 3 to 5.

Elsewhere, a system balance weight 19 is coupled to the guide pot 4, being fixed to the latter on the opposite side to that to which the advance system is fitted.

Finally, since the advance system is fitted in the sealed housing, it can be activated either by an independent motor, or by one of the control shafts 6 for the first vertical drive system, or by a rod fitted directly to a cam mounted on one of the control shafts 6 of the first drive system.

FIG. 2 shows another method of implementation of a needle plate machine according to the invention. The housing is shown in cross-section and the rest of the needle plate machine in a front view, part of a guide pot being cut away.

This needle plate machine comprises two needle plates 10' with needles 1' projecting from the lower face of the plate being arranged either in rows and columns, or randomly, or pseudo-randomly, as is well known in the field. Each needle plate 10' is carried by a respective beam 2', called the moving beam. The needles are designed to have an elliptical to and fro and up and down path from top to bottom and from bottom to top to pass through, in one direction then the other, a fleece or web of fibres passed in front of them in the drive or MD direction, or from left to right horizontally to the diagram.

Two longitudinal columns 3' extend along the longitudinal axes 11' perpendicular to the plane of the plate. The columns 3' are each connected to a moving beam 2', so that the motion of the column 3', the moving beam 2', the needle plate 10' and the needles are similar, even identical, that is with the same elliptical path or an elliptical path of the same shape but different size. In addition the two paths may be in opposition, that is the two ellipses are mirror images of each other.

Drive systems are fitted to impart to each column 3' (and thus also to the needle plates 10, the moving beams 2' and the needles 1) a motion with a component in a direction parallel to the longitudinal axis 11' and a component in the direction MD, so as to have an elliptical path as shown in FIG. 2 by an ellipse for the needles.

An oil-tight housing 7' encloses the drive systems and part of the columns 3', the latter passing through the wall of the housing 7' through the respective guide pots 4', whose interfaces with the housing 7' are rendered oil-tight by means of seals (not shown, but which for example can be in the form of bellows joints as shown in FIG. 1A). Each guide pot 4' can oscillate with respect to an axis 5', fixed in relation to the housing 7' and parallel to the direction CD (perpendicular to the direction MD and the longitudinal axis 11'). Each column 3' can slide inside its respective guide pot 4'. Guide bushes 16 are fitted in the internal wall of each guide pot 4' to ensure sliding and lubrication between the column 3' and respective guide pot 4'. Oil-tightness between the column 3' and the respective guide pot 4' is provided by a seal (not shown) fixed to the base of the guide pot.

The drive systems comprise first longitudinal drive systems configured to impart a to and fro motion to each column in a direction parallel to the longitudinal axis. These first drive systems consist of two systems with cam shafts 6' and rods 13'.

The shafts 12' drive the heads of the two rods 13' (as shown by the two arrows at the top in FIG. 1) in opposite directions. The feet 14' of the two rods 13' are each hinged to one end of a respective column 3'.

These first vertical, longitudinal drive systems impart to each column 3' a to and fro motion in a direction essentially parallel to the longitudinal axis.

Second transverse drive systems are also fitted in the form of a main tie-rod 8' and an auxiliary tie-rod 9' fitted in the direction MD inside the housing 7'. One end of the tie-rod 8' is hinged to one of the guide pots 4' at a point 17' away from the axis of rotation 5' of the pot, in particular essentially to the upper end of the pot. The other end of the tie-rod 8' is coupled to a drive system called the advance system, which in particular can be like those shown below in FIGS. 3 to 5.

The auxiliary tie-rod 9' is hinged at its opposite ends to a respective tie-rod of the pots 4'. In particular, the tie-rod 9' is also hinged to the end of tie-rod 8' hinged at point 17', but this is not obligatory as the system also works if the ends of the tie-rods 8' and 9' are not hinged at the same point, the tie-rod 8' may be hinged with an independent pin fixed to the guide pot.

A to and fro oscillatory motion is also imparted to the two guide pots 4' which is transferred to the columns 3' that traverse with a to and fro motion in the direction MD, or essentially in the direction MD (as shown by the double arrow above the tie-rod 8' in FIG. 2).

Secondly, a system balance weight 19' is coupled to the auxiliary tie-rod 9', being fixed to the latter on the upper side half way between the shafts 12'.

Finally, as the advance system is retained in the sealed housing, it may be actuated either by an independent motor, or by one of the control shafts 12' of the first vertical drive system, or by a rod mounted directly on a cam fitted to one of the control shafts 12' of the first vertical drive system.

In particular, as shown in FIG. 2, which shows a variant of the method of implementation in FIG. 2, but which can also be applied to the method of implementation in FIG. 1, a mechanical linkage is fitted between the main tie-rod 8' and a transverse drive rod 51 driven by the cam shaft 12' of one of the two rod and cam shaft systems 6', for example, as shown in FIG. 2A, by the cam shaft 12' which also drives the rod 13' hinged to the pot 4' and is also linked directly to the tie-rod 8'. In this variant of FIG. 2A, an intermediate lever 52 is fitted that rotates about a pin 53 fixed with respect to the housing 7' and hinged directly at both ends to the rod 51 and the main tie-rod 8' respectively.

In the above description, the first longitudinal drive system is distinct from the second transverse drive system. Although separation into two distinct halves has advantages, it would however be possible to fit single drive systems that perform the functions of the first and second drive systems, while remaining within the scope of the invention as defined by the claims.

FIGS. 3, 3A, 3B, 4A, 4B and 5 show methods of implementation of a system that can be used to control the to and fro motion in the direction MD of the tie-rods 8 and 8' respectively of the methods of implementation in FIGS. 1 and 2. However, this control system per se is not necessary and other to and fro motion control systems in the direction MD of tie-rods 8 and 8' known from the prior art can be used, for example systems such as those described in EP-A1-1736586, EP-B1-3372716, FR2738846, U.S. Pat. No. 6,161,269 and the like.

In FIG. 3, the system comprises a cam shaft 21 coupled to a rod 22 hinged directly to a one-piece vertical lever 23 that pivots around an offset fixed pin 24, in the vertical direction, below the hinge pin of the rod 22 to the lever 23. A tie-rod 27 is coupled directly to the lever 23. The tie-rod 27 is fixed to a slider 25 and one end of a rod 26 whose pin is parallel to the pin 24.

The relative position of the rod 26, and therefore also the tie-rod 27, in relation to the pivot pin 24 of the lever in the vertical direction and/or in relation to the hinge pin of the rod 22 to the lever can be adjusted by means of an adjustment system consisting of an auxiliary adjustment cam shaft 29 and an adjustment tie-rod 28. The adjustment tie-rod 28 is hinged at its upper end to the cam shaft (or crankshaft) 29, while its lower end can pivot in relation to the pin of the rod 26.

The lever contains an opening in the form of a slot 30, in which slides the slider 25 of the rod 26 which is fixed in translation.

Depending on the position of the tie-rod 28, which is determined by appropriate rotation of the crankshaft 29, the relative position of the slider 25 in the slot 30 can be chosen and adjusted in order to adjust the distance in the vertical pin of the lever between the pin 24 and the pin of the rod 26 (and therefore also the distance between the pin of the rod 26 and pin 22), this distance can be varied from zero (position of the slider 25 at the top of the slot 30 until the pin of the rod 26 corresponds with the pin 24 and the position of maximum adjustment, when the slider 25 is at the bottom of the slot 30).

The amplitude of the to and fro motion of the tie-rod 27 can be varied either when running or when at rest, the motion transferred from the movement of the crankshaft 21 and the tie-rod 22 acting on the lever 23. Regarding the tie-rod 27, it can either be rigidly connected or hinged to one or other of the main tie-rods 8 and 8' in the methods of implementation in FIGS. 1 and 2.

FIG. 3A shows a variant of the arrangement in FIG. 3. In this variant, the distance between the rod 22 and the drive tie-rod 27 can be adjusted by varying the position along the slot 30 of the hinge pin 31 of the rod 22 to the lever 23, which varies the distance between hinge pin 31 of the rod 22 and the fixed pivot pin 24 of the lever, therefore also varying the distance between the pin 31 and the tie-rod 27, the distance between the tie-rod 27 and the pin 24 being fixed in this variant, while in the method of implementation in FIG. 3, it is the distance between pin 31 and pin 24 that is fixed.

FIG. 3B shows a variant of the arrangement in FIG. 3. In this variant, the distance between the rod 22 and the drive tie-rod 27 is adjusted by adjusting the position of the fixed pivot pin 24 of the lever in the slot 30' formed in the lever 23. The lever pin 24 is rigidly connected to a slider 25' which slides in the slot 30'. The rod 22 is hinged to the lever 23 along a hinge pin 31 which is in a fixed position on the lever 23. The hinge end of the of the tie-rod 27 to the lever 23 is in a fixed position (as in the method of implementation in FIG. 3). Similarly, the rod 26 projecting from the adjustment tie-rod 28 is hinged to the lever 23 at a fixed position. The relative position of the pin 24 in relation to the lever 23 can be adjusted by means of the tie-rod 28, thereby adjusting the relative position of the tie-rod 27 in relation to the pin 24 and the relative position of the rod 22 in relation to the pin 24, thereby adjusting the to and fro stroke of the tie-rod 27, the distance between the tie-rod 27 and the rod 22 in this variant is fixed.

FIGS. 4A and 4B show another method of implementation. The main difference between the method of implementation in FIG. 3 and those in FIGS. 4A and 4B is the way in which the position of the slider 25 is adjusted in relation to the slot 30.

In this method of implementation a spiral cam is used, consisting of a disk 40 containing a spiral slot along which the rod 26 moves. When the disk 40 rotates, the rod 26 follows the profile of the spiral slot which moves the rod 26 and therefore the slider 25 along the slot 30. Depending on the position chosen along the spiral for the pin 26, a given to and fro stroke of the tie-rod 27 is obtained.

FIG. 5 shows yet another method of implementation in which an actuator 41 is used instead of the crankshaft 29 in FIG. 3, the rest of the method of implementation is the same.

In the methods of implementation described in FIGS. 4A, 4B and 5, the arrangements for the variants in FIGS. 3A and 3B can be implemented instead of the arrangement described here, in which it is the distance between the pin 24 and the tie-rod 27 that is adjusted (as in the variant in FIG. 3).

The invention claimed is:

1. A needling device to consolidate a non-woven fleece or web of fibres comprising:

one or more needle plates having one array or bank of needles respectively;

one or more columns, each said column having a longitudinal axis extending along a longitudinal direction and being rigidly connected to the needle plate or plates respectively;

drive systems configured to impart a to and fro motion to each needle plate so that the needles trace an elliptical path to pass through the fleece or web of fibres moving in front of the needles in a machine or MD drive direction to consolidate said fleece or web of fibers;

a sealed housing containing part of the column or columns and part of the drive system or drive systems; and one or more guide pots fitted in a respective opening of the sealed housing and pivoting around a respective pin, said respective pin being fixed in relation to the sealed housing and perpendicular to the longitudinal axis and to the direction MD, each column or columns passing through the housing by means of the guide pot or pots respectively by sliding in said one or more guide pots, the drive system comprising a longitudinal drive system configured to impart a to and fro motion to each column or columns in a direction essentially parallel to the longitudinal axis, wherein the drive system also comprises a transverse drive system configured to impart to a guide pot point of each guide pot of the one or more guide pots at a distance from a respective pin of each guide pot of the one or more guide pots a to and fro motion in a direction essentially parallel to the direction MD; and wherein each said respective pin lies closer to said needles than said guide pot point lies to said needles.

2. The device according to claim 1, characterised in that the respective pin of each guide pot of the one or more guide pots lies in the respective opening of the housing.

3. The device according to claim 1, characterised in that the longitudinal drive system comprises two rod-cam shaft systems each including a rod wherein a head of each rod being hinged to respective cam shafts, and wherein each rod includes a respective foot and wherein the two feet of the rods are linked to each other by being hinged at a respective end of an intermediate tie-rod, the intermediate tie-rod being hinged to a column of the one or more columns.

4. The device according to claim 1, characterised in that the device comprises two columns and two guide pots, and the longitudinal drive system comprises two rod-cam shaft systems wherein respective heads of respective rods of each rod-cam shaft system are hinged to respective cam shafts and each rod is hinged to its respective column.

5. The device according to claim 4, characterized in that each rod-cam shaft system includes cam shafts that rotate at the same speed.

6. The device according to claim 5, characterised in that the cam shafts rotate in opposite directions.

7. The device according to claim 1, characterised in that the transverse drive system comprises a main tie-rod, wherein a first end of said main tie-rod is hinged to one of the one or more guide pots, and a second end of the main tie-rod is hinged to the longitudinal drive system to impart to the main tie-rod a to and fro motion in a direction essentially parallel to the direction MD.

8. The device according to claim 7, characterised in that said device further comprises at least a second column enclosed in a respective guide pot, and an auxiliary tie-rod, wherein two ends of the auxiliary tie-rod are each respectively hinged to one of the two respective guide pots.

9. The device according to claim 8, characterised in that a hinge point at the first pot of the main tie-rod and a hinge point at the first pot of the auxiliary tie-rod are combined.

10. The device according to claim 1, characterised in that the longitudinal drive system is configured to impart to a least one column a to and fro motion only in a direction parallel to the longitudinal axis.

11. The device according to claim 1, characterised in that the transverse drive system is configured to impart to said guide pot point on at least one guide pot of the one or more guide pots a to and fro motion in a direction parallel to the direction MD.

12. The device according to claim 7, characterised in that a mechanical linkage is fitted between the main tie-rod and a transverse drive rod driven by a cam shaft of one of two rod and cam shaft systems.

13. The device according to claim 12, characterised in that one of the two rod and cam shaft systems and two guide pots are fitted together and the cam shaft that drives a rod of the two rod and cam shaft systems that is hinged to one of the two guide pots is linked directly to the main tie-rod that drives the transverse drive rod.

14. The device according to claim 13, characterised in that an intermediate lever is rotatingly fitted in relation to a pin fixed in relation to the housing and wherein the intermediate lever is hinged directly to both the main rod and tie-rod.

15. The device according to claim 1, characterised in that the longitudinal and transverse drive systems are contained inside the sealed housing.

16. The device according to claim 1, wherein the longitudinal drive system imparts a vertical to and fro motion to each column.

17. The device according to claim 3, wherein the intermediate tie-rod is hinged to a column of the one or more columns at a point half-way between the two feet of the rods.

18. The device according to claim 1, wherein said guide pot point of each guide pot of the one or more guide pots lies inside said housing.

* * * * *